US009027299B2

(12) United States Patent
Mea

(10) Patent No.: US 9,027,299 B2
(45) Date of Patent: May 12, 2015

(54) THEMED MODULAR CEILING AND WALL DECOR KIT AND SYSTEM

(71) Applicant: Joseph Mea, Matawan, NJ (US)

(72) Inventor: Joseph Mea, Matawan, NJ (US)

(73) Assignee: Joseph Mea

( * ) Notice: Subject to any disclaimer, the term of this patent is extended or adjusted under 35 U.S.C. 154(b) by 0 days.

(21) Appl. No.: 14/313,081

(22) Filed: Jun. 24, 2014

(65) Prior Publication Data

US 2015/0013256 A1 Jan. 15, 2015

Related U.S. Application Data

(60) Provisional application No. 61/957,752, filed on Jul. 12, 2013.

(51) Int. Cl.
*E04F 13/073* (2006.01)
*E04F 19/04* (2006.01)

(52) U.S. Cl.
CPC ..... *E04F 13/0733* (2013.01); *E04F 19/0436* (2013.01)

(58) Field of Classification Search
CPC ... E04F 19/0436; E04F 19/02; E04F 19/0463; E04F 19/0495; E04F 13/0733; E04F 2019/0454; E04F 2019/044; E04F 13/0864; E04F 13/0871
USPC ..... 52/288.1, 287.1
See application file for complete search history.

(56) References Cited

U.S. PATENT DOCUMENTS 1,825,010 A * 9/1931 Murphy ..... 52/288.1
3,302,350 A * 2/1967 Brown et al. ..... 52/288.1
3,464,177 A * 9/1969 Amato ..... 52/288.1
3,500,036 A * 3/1970 Szentveri ..... 362/152
3,707,061 A * 12/1972 Collette et al. ..... 52/288.1
4,067,155 A * 1/1978 Ruff et al. ..... 52/105
4,296,583 A * 10/1981 Egenlauf ..... 52/717.01
4,996,801 A * 3/1991 Ristow et al. ..... 52/58
5,001,877 A * 3/1991 Edwards ..... 52/288.1
5,179,811 A * 1/1993 Walker et al. ..... 52/288.1
5,398,469 A * 3/1995 Logan ..... 52/288.1
5,426,901 A * 6/1995 Indracek ..... 52/288.1
5,433,048 A * 7/1995 Strasser ..... 52/288.1
5,457,923 A * 10/1995 Logan et al. ..... 52/288.1
5,555,687 A * 9/1996 Logan et al. ..... 52/288.1
5,592,797 A * 1/1997 Logan et al. ..... 52/288.1
5,651,224 A * 7/1997 Brabant ..... 52/288.1
5,662,753 A * 9/1997 Loos ..... 156/71
5,711,123 A * 1/1998 Lamont et al. ..... 52/287.1
5,732,747 A * 3/1998 Holliday ..... 138/163
5,802,790 A * 9/1998 Lamont et al. ..... 52/288.1

(Continued)

*Primary Examiner* — James Ference
(74) *Attorney, Agent, or Firm* — Usha S. Koshy

(57) ABSTRACT

A themed modular ceiling and wall décor kit and system to change the theme and décor of any room with the use of rudimentary tools such as a tape measure, level and screw driver. An inexpensive and semi-permanent alternative to the permanent and expensive crown moldings requiring the services of a professional carpenter for their installation as well as removal. The modular ceiling and wall decor kit has limitless possibilities for modification in appearance and design as for instance, a room décor that is for a young child can be changed to suit an older child, or a room décor for a female changed to a male's room décor or when a themed presentation is called for in a child's room or other dedicated room such as a room displaying a sportsman's memorabilia, through the use of different designer panels in the crown molding housing of the décor kit.

7 Claims, 15 Drawing Sheets

(56) References Cited

U.S. PATENT DOCUMENTS

| | | | | | |
|---|---|---|---|---|---|
| 5,823,655 | A * | 10/1998 | Brooks | 362/145 |
| 5,836,113 | A * | 11/1998 | Bachman | 52/94 |
| 6,084,180 | A * | 7/2000 | DeBartolo et al. | 174/95 |
| 6,115,982 | A * | 9/2000 | Lindenberg | 52/506.05 |
| 6,148,584 | A * | 11/2000 | Wilson | 52/717.01 |
| 6,219,980 | B1 * | 4/2001 | Peck, Jr. | 52/288.1 |
| 6,230,385 | B1 * | 5/2001 | Nelson | 29/450 |
| 6,253,510 | B1 * | 7/2001 | Santarossa | 52/287.1 |
| 6,318,039 | B1 * | 11/2001 | Watson et al. | 52/288.1 |
| 6,381,915 | B1 * | 5/2002 | Wood | 52/718.06 |
| 6,385,939 | B1 * | 5/2002 | Stout | 52/718.01 |
| 6,557,311 | B1 * | 5/2003 | Mongelli | 52/288.1 |
| 6,837,020 | B1 * | 1/2005 | Keddell | 52/745.2 |
| 6,932,303 | B2 * | 8/2005 | Snyder | 248/58 |
| 7,040,065 | B2 * | 5/2006 | Pickup | 52/287.1 |
| 7,041,898 | B2 * | 5/2006 | Stempinski et al. | 174/488 |
| 7,200,970 | B2 * | 4/2007 | Koenig et al. | 52/287.1 |
| 7,451,574 | B2 * | 11/2008 | Spek | 52/288.1 |
| 2001/0045076 | A1 * | 11/2001 | Boomer | 52/716.1 |
| 2003/0014931 | A1 * | 1/2003 | Hahn | 52/287.1 |
| 2004/0211141 | A1 * | 10/2004 | Sandy | 52/506.01 |
| 2005/0166527 | A1 * | 8/2005 | Ernest et al. | 52/716.1 |
| 2005/0210784 | A1 * | 9/2005 | Hahn | 52/287.1 |
| 2005/0257485 | A1 * | 11/2005 | Hahn | 52/716.1 |
| 2006/0026916 | A1 * | 2/2006 | Poupart | 52/272 |
| 2006/0260262 | A1 * | 11/2006 | Richardson | 52/716.1 |
| 2006/0272269 | A1 * | 12/2006 | Bannister | 52/718.01 |
| 2007/0119107 | A1 * | 5/2007 | Shaw et al. | 52/287.1 |
| 2007/0251167 | A1 * | 11/2007 | Kaplan | 52/287.1 |
| 2007/0271865 | A1 * | 11/2007 | Rowohlt | 52/287.1 |
| 2008/0092470 | A1 * | 4/2008 | Jackson | 52/288.1 |
| 2008/0263979 | A1 * | 10/2008 | Richardson | 52/287.1 |
| 2009/0064613 | A1 * | 3/2009 | Ouyang et al. | 52/288.1 |
| 2009/0293392 | A1 * | 12/2009 | Dykstra et al. | 52/288.1 |
| 2010/0071288 | A1 * | 3/2010 | Jun | 52/288.1 |
| 2010/0186341 | A1 * | 7/2010 | Shoopman | 52/718.01 |
| 2010/0242389 | A1 * | 9/2010 | DePaul | 52/288.1 |
| 2010/0313498 | A1 * | 12/2010 | Paidar et al. | 52/173.1 |
| 2013/0091791 | A1 * | 4/2013 | Hardy | 52/288.1 |

* cited by examiner

THEMED MODULAR CEILING AND WALL DECOR KIT AND SYSTEM

CROSS REFERENCE TO RELATED APPLICATION

This application claims priority under 35 USC 119(e) to U.S. Provisional Patent Application, Ser. No. 61/957,752 filed, Jul. 12, 2013.

FIELD OF THE INVENTION

The present invention is generally related to modular ceilings. More particularly, the invention relates to a modular ceiling and wall décor kit to enhance the aesthetic appeal of a room within a house or other dwelling.

BACKGROUND OF THE INVENTION

The type of ceilings incorporated within the rooms of a dwelling whether a house or other structure is generally determined by the desires of the home owner who is having the house built to their specifications, or the builder who constructs the house or other buildings with the intent of selling the structures.

Ceilings incorporated within the four walls of a room in a house, apartment, or other structure generally comprise of, plain, generic, ceilings which may be flat or slightly textured to match the walls, or more elegant ones such as coffered ceilings, beam ceilings, cathedral or vaulted ceilings, and trey ceilings. A coffered ceiling is a specialty ceiling treatment that divides a ceiling into a grid of recessed panels that are square or rectangular in shape, accented by dropped beams and typically finished with a variety of interior trims and molding options. A beam ceiling is a specialty ceiling treatment usually incorporated in eclectic home designs and combines various styles together in creating interesting depths and contrasting looks. With cathedral or vaulted ceilings, sloping lines extend up to the top of a house to make a room look taller, larger and more spacious. Trey ceilings are built upwards either vertically or angled in a cutout, resembling a tray, and incorporates artistic elements to give the ceiling personality and unique attributes.

Ceilings that are plain and generic are often glamorized with the use of crown moldings of various styles, shapes and textures. Regardless of the type of crown molding used in a room, there are several drawbacks relating to their installation and maintenance. Besides the expense involved in paying professional carpenters to install the crown moldings, once they are installed they are permanent in nature and therefore cannot be taken down to be replaced with another type or style of molding to match the new wall décor of a room as for instance when a themed presentation is called for in a child's room or other dedicated room such as a room displaying a sportsman's memorabilia.

The present invention overcomes a deficiency in the prior art for replaceable crown moldings to match wall decors by providing a modular ceiling and wall décor kit that can be easily and effortlessly installed and taken down to be replaced with another modular ceiling and wall décor when desired.

SUMMARY OF THE INVENTION

The present invention is a modular ceiling and wall décor kit and system to change the décor of a room when needed and as desired with minimal labor, using simple hardware.

It is an object of the present invention to provide a modular ceiling and wall décor kit that can seamlessly coordinate the décor of the ceiling and the wall to provide an aesthetically pleasing appearance for the room.

It is a further object of the invention to provide a modular ceiling and wall décor kit and system that can be effortlessly installed by a home or apartment dweller using only rudimentary implements such as a screw driver and tape measure.

A related object of the present invention is to provide a modular ceiling and wall décor kit and system that can be easily dismantled and used again at a later date in the same or another room in the dwelling.

Yet another object of the present invention is to provide a modular ceiling and wall décor kit that is inexpensive so that changing from one décor to another can be achieved at minimal cost.

Another object of the present invention is to provide a modular ceiling and wall decor kit with limitless possibilities for modification in appearance and design such that for instance, a room décor that is for a young child can be changed to one that suits an older child, or a room décor for a female changed to a male's room décor.

The exemplary embodiment of the crown molding system of the present invention is comprised of three primary components, a crown molding housing, a track to secure the housing at the ceiling wall joint and a series of design display panels that can be slid in and out from the crown molding housing to highlight the desired interchangeable profile look.

The objects, features and advantages of the present invention described in this summary of the invention will be further appreciated and will become obvious to one skilled in the art when viewed in conjunction with the accompanying drawings, detailed description of the invention, and the appended claims.

DETAILED DESCRIPTION OF THE INVENTION

The present invention is a modular ceiling and wall décor kit and system comprising prefabricated high density plastic that can be structured in a variety of shapes and sizes and easily and effortlessly installed using the most rudimentary implements, such as, a ruler, level and a screw driver, to create dramatic-looking crown moldings in any room of a house, apartment, or other dwelling and match the crown moldings with the wall décor in the room. The modular ceiling and wall décor system of the present invention advantageously provides an inexpensive and semi-permanent alternative to the permanent and expensive crown moldings that generally require the services of a professional carpenter for their installation as well as removal. The modular ceiling and wall décor kit of the invention can be used to create a variety of ceiling effects including, a trey ceiling effect, a coffered ceiling effect as well as other ceiling effects.

Figure 1:
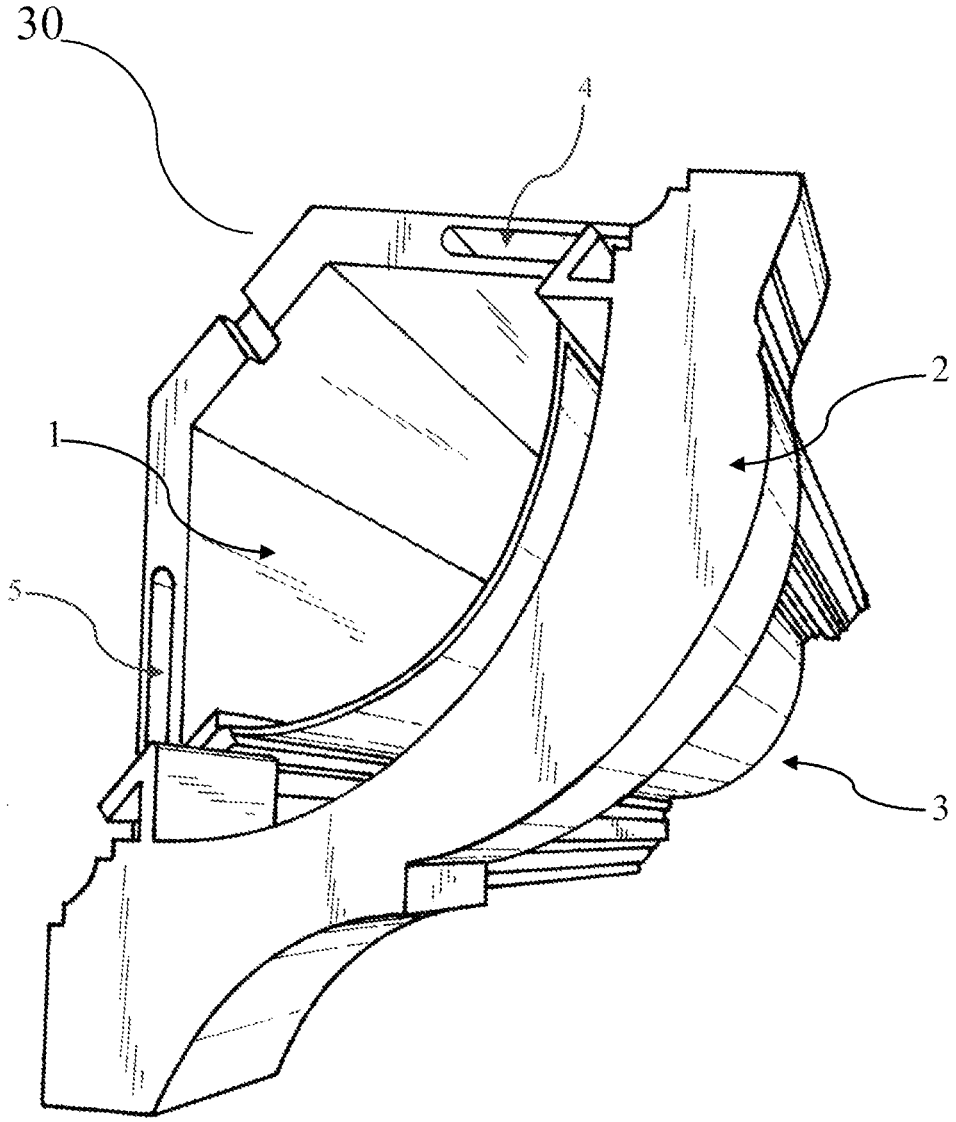
FIG. 1 is a perspective cross sectional view of the exemplary embodiment of the crown molding system of the present invention.

Referring now to the drawings, more particularly, to FIG. 1 the figure shows a cross sectional perspective view of the exemplary embodiment of the crown molding system 30 of the present invention with all the components of the system assembled and interlocked with each other. The main components of the system 30 are the crown molding housing 1 the corbel 2 and the design panel 3. When all three components are assembled, they together create a unique and customized home décor crown molding that can be installed both inside as well as the outside of a dwelling with minimal effort, using rudimentary tools such as a tape measure, level and a screw driver. In this embodiment of the crown molding system 30 a pair of biscuit joiner slots 4 and 5 facilitate jointer of one crown molding housing structure to another in a tongue and groove manner to provide a seamless appearance to the crown molding system 30 when it is installed.

Figure 2:
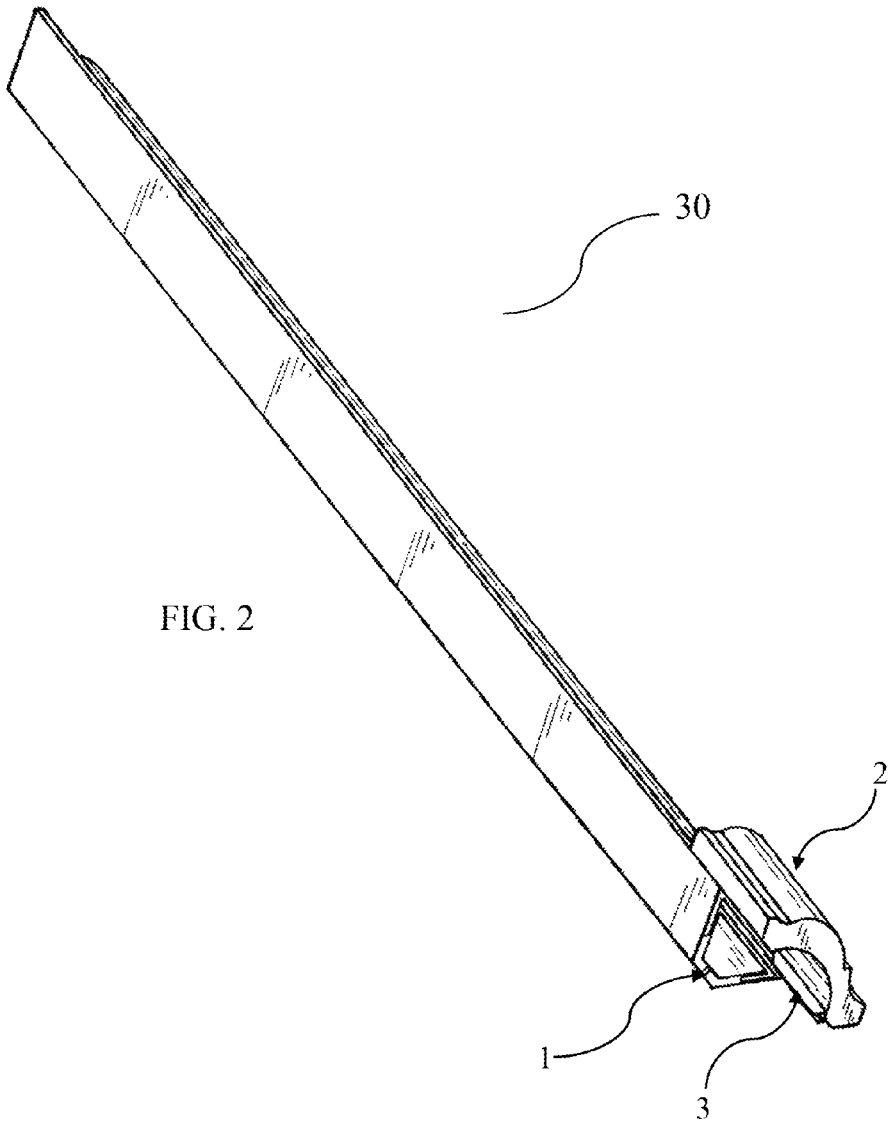
FIG. 2 is a perspective side view of the exemplary embodiment of the crown molding system of the present invention.

FIG. 2 shows another perspective view of the assembled components of the crown molding system 30 of the present invention. In this view, the corbel 2 is seen placed on the outer track of the crown molding housing. When the corbel 2 is thus placed on the outer track of the crown molding housing, it can easily be moved into a position that will hide the seams where two sections of the crown molding housing structures of the system 30 meet and interlock with each other.

Figure 3:
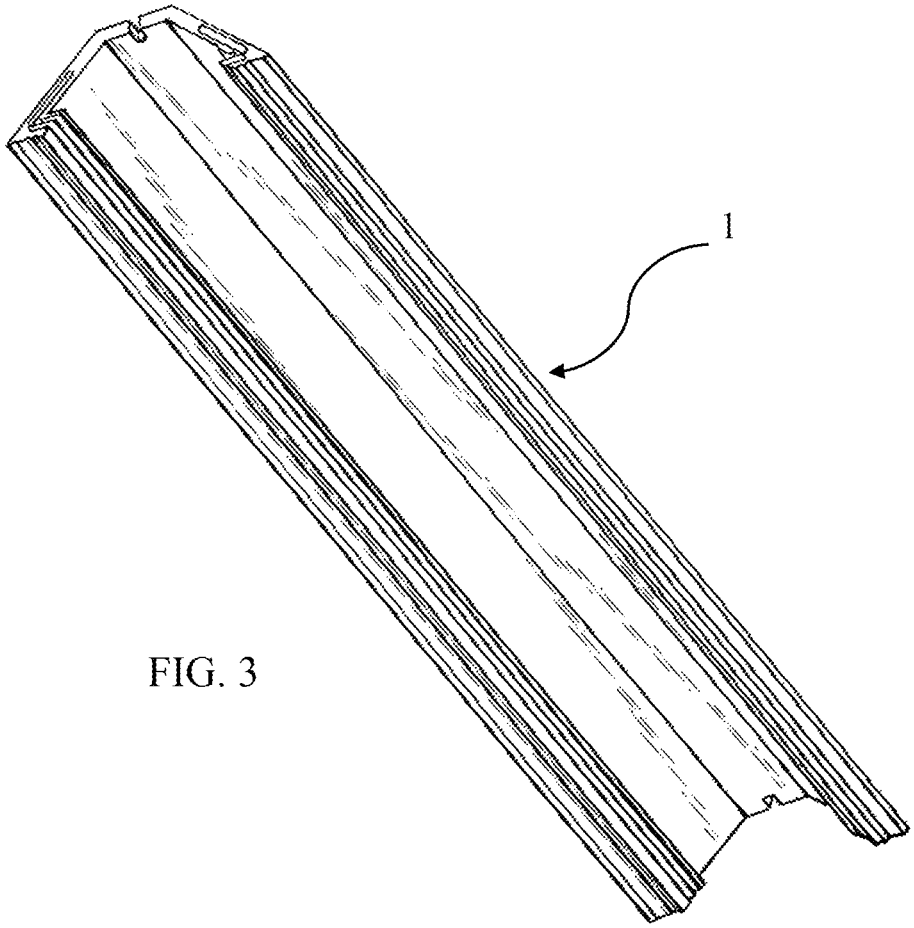
FIG. 3 is a perspective front view of the crown molding housing section of the present invention.

FIG. 3 is a front perspective view of the crown molding housing 1 which comprises of a track and a design panel that is interchangeable to suit the décor of the room. The crown molding housing 1 is screwed into the 90 degree corner where the ceiling and wall meet using a screw driver and standard screws. Prior to installation of the crown molding system 30 to the ceiling, the track and the crown molding housing 1 are cut to the desired length. The next step is to secure the track to the ceiling and once that is accomplished, the crown molding housing is fitted to the tracks and the display panel inserted into the housing.

Figure 4:
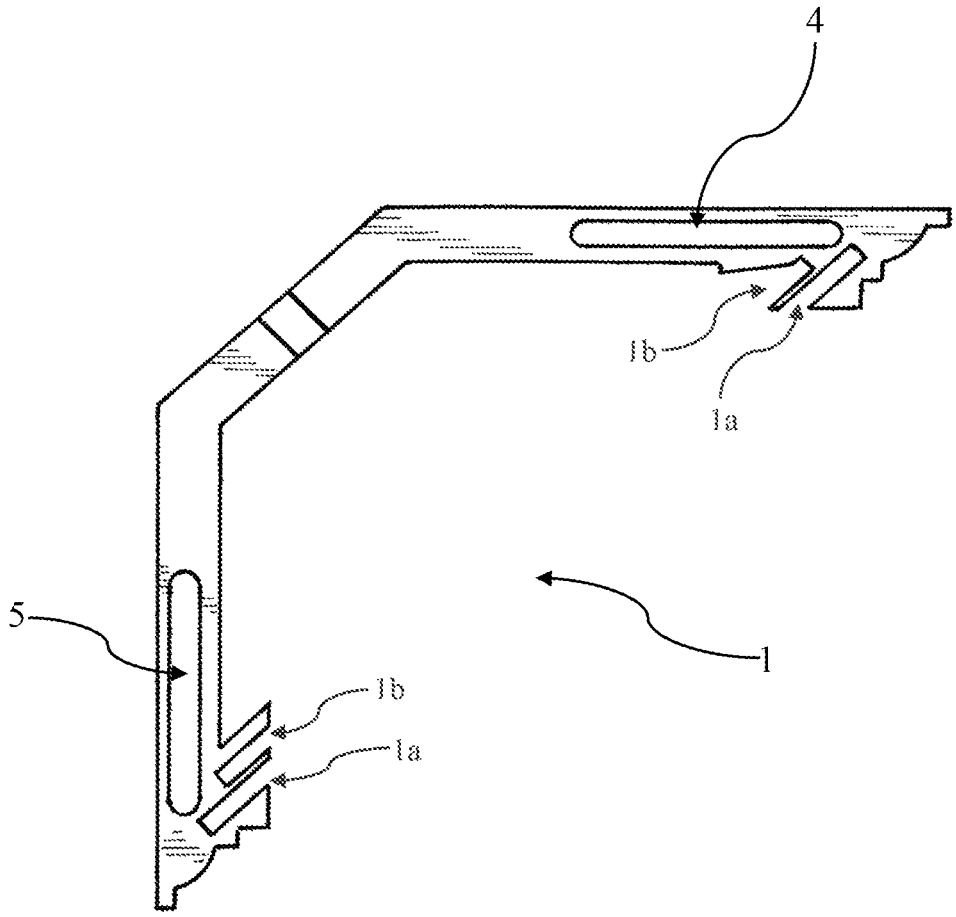
FIG. 4 is a perspective side view of the crown molding housing section of the present invention illustrating the biscuit joiners.

FIG. 4 is a perspective side view of the crown molding housing section of the present invention illustrating the biscuit joiner slots 4 and 5 to facilitate joining two sections of the crown molding assembly systems together in a tongue and groove manner to provide a seamless appearance to the crown molding system when it is installed. This figure also illustrates the positioning of the outer tracks, 1*a* and the inner tracks 1*b* on the crown molding housing structure.

Figure 5:
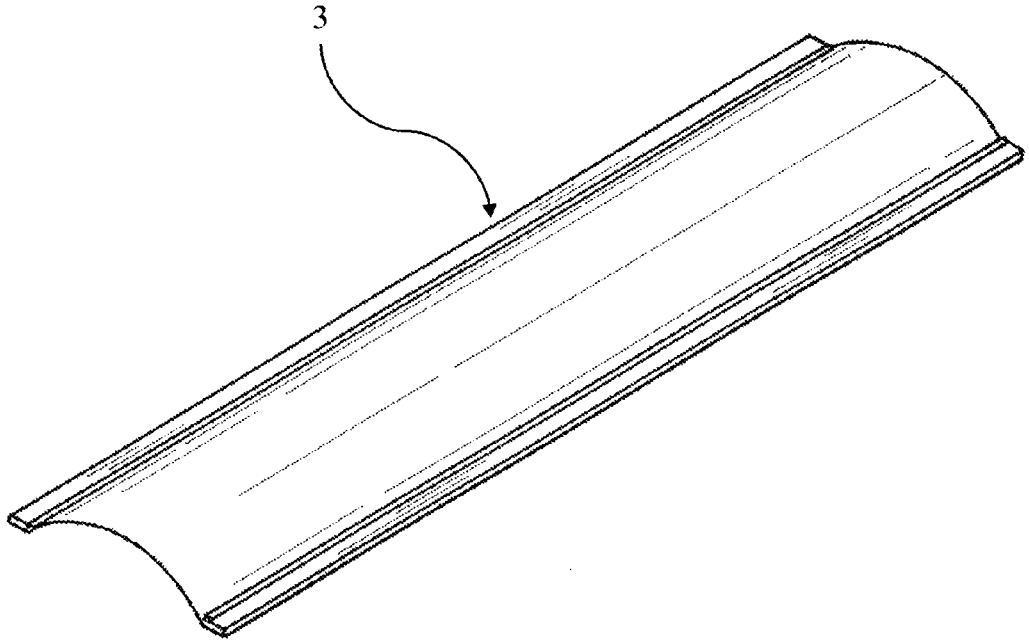
FIG. 5 is a perspective view of the removable design panel of the crown molding system of the present invention.

FIG. 5 is a perspective view of the removable design panel 3 of the crown molding system of the present invention. This view shows the curved front part of the panel 3 which can display any design that is affixed to it through its length. The design panel 3 is inserted through the rear, inner tracks of the crown molding housing using the hands or with a simple tool. The design panel can have an unlimited variety of designs of different textures such as rhinestones, faux animal fur prints, metallic designs etc., pasted to it. These panels can be interchanged to suit the wall and room décor.

Figure 6:
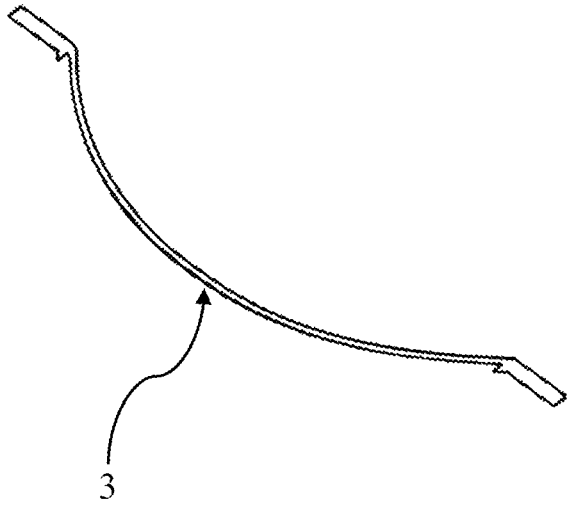
FIG. 6 is a perspective left side cross sectional view of the removable designer panel of the crown molding system of the present invention.
Figure 7:
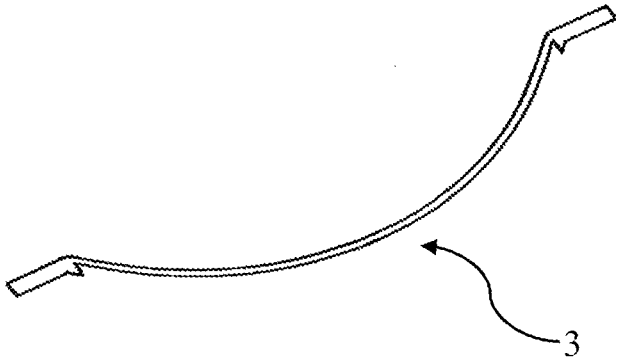
FIG. 7 is a perspective right side cross sectional view of the removable designer panel of the crown molding system of the present invention.

FIG. 6 and FIG. 7 are perspective cross sectional views of the removable design panel 3 of the crown molding system of the present invention when viewed from the left and right sides of the design panel 3. The design panel 3 with the preferred design affixed to the outside of the panel is inserted into the rear inner track of the crown molding housing and can be removed effortlessly without the use of tools.

Figure 8:
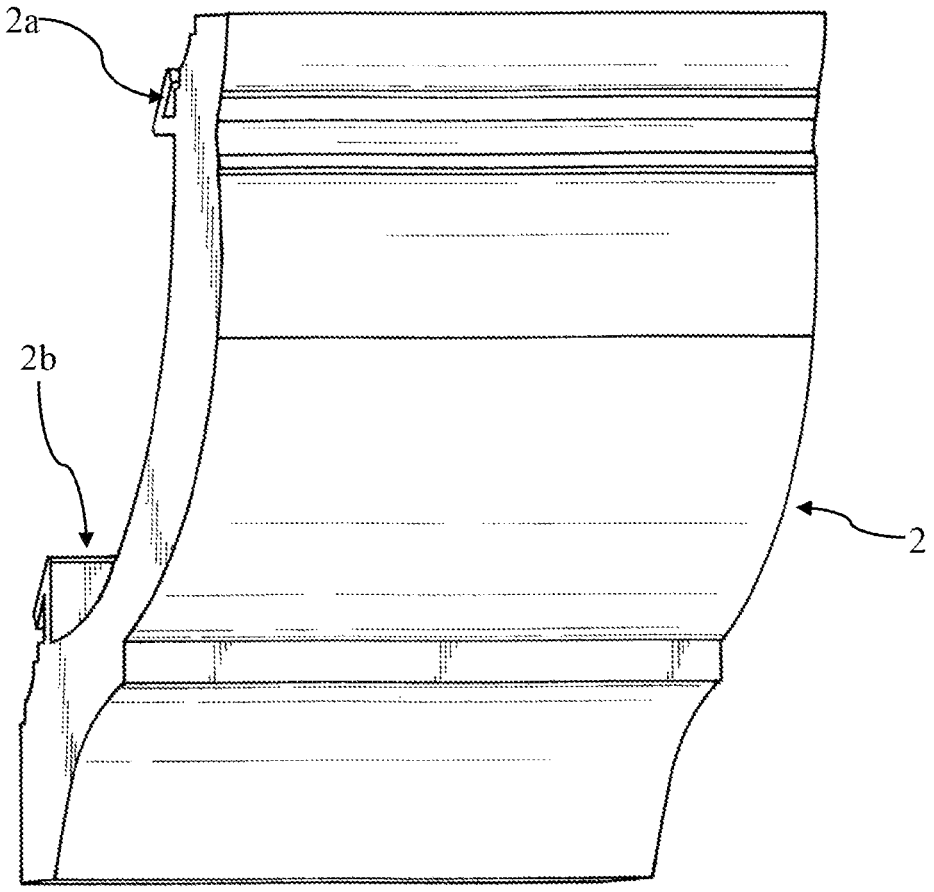
FIG. 8 is a perspective view of the front of the corbel in the crown molding system of the present invention.

FIG. 8 is a perspective view of the front of the corbel 2 in the crown molding system of the present invention. The corbel 2 has an upper track 2*a* and lower track 2*b* through which the corbel 2 is inserted into the crown molding housing before installation of the molding to the ceiling. The corbel 2 is able to slide freely in the easy glide outer front track of the crown molding at any point after installation. The curved surface between the upper track 2*a* and lower track 2*b* will have a foam pad that is glued on to that surface and the pad will hide any gaps and allow for the insertion of different design profile panels having different protrusions.

Figure 9:
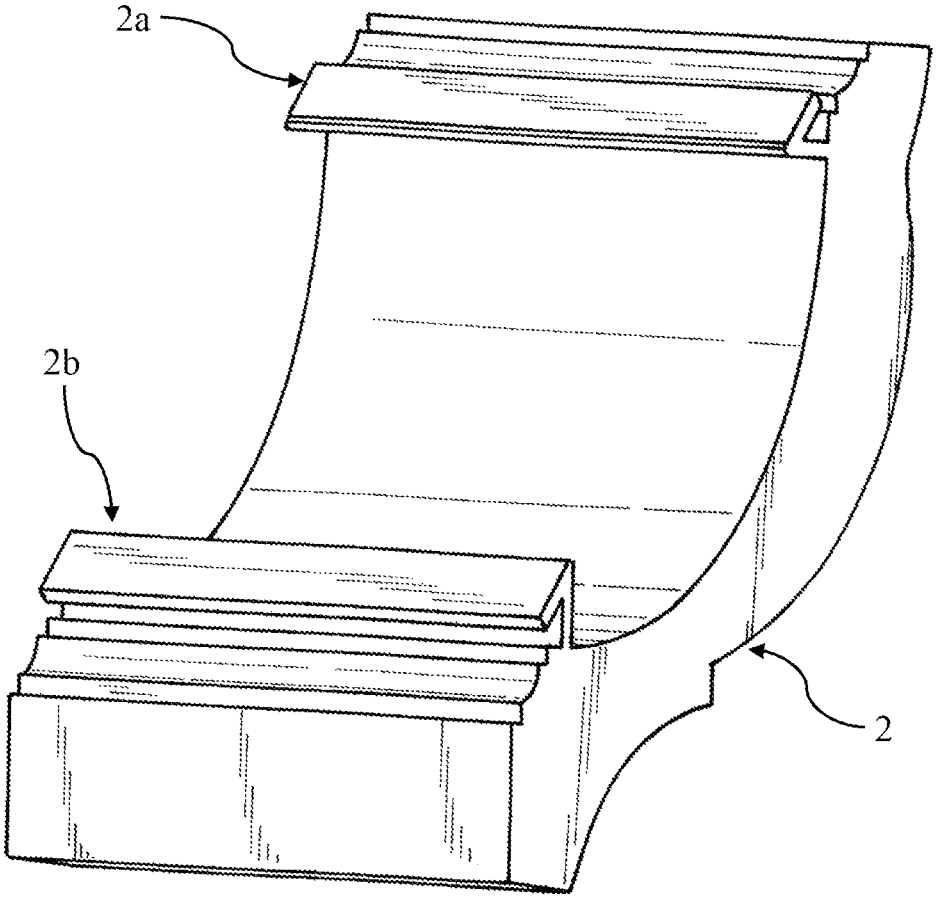
FIG. 9 is a perspective view of the rear of the corbel in the crown molding system of the present invention.

FIG. 9 is a perspective view of the rear of the corbel 2 in the crown molding system of the present invention. The rear of the corbel 2 is designed for movement in order to conceal/hide the seams where the crown molding sections meet and also to remove and insert different design profile panels and hide any gaps between the panels.

Figure 10:
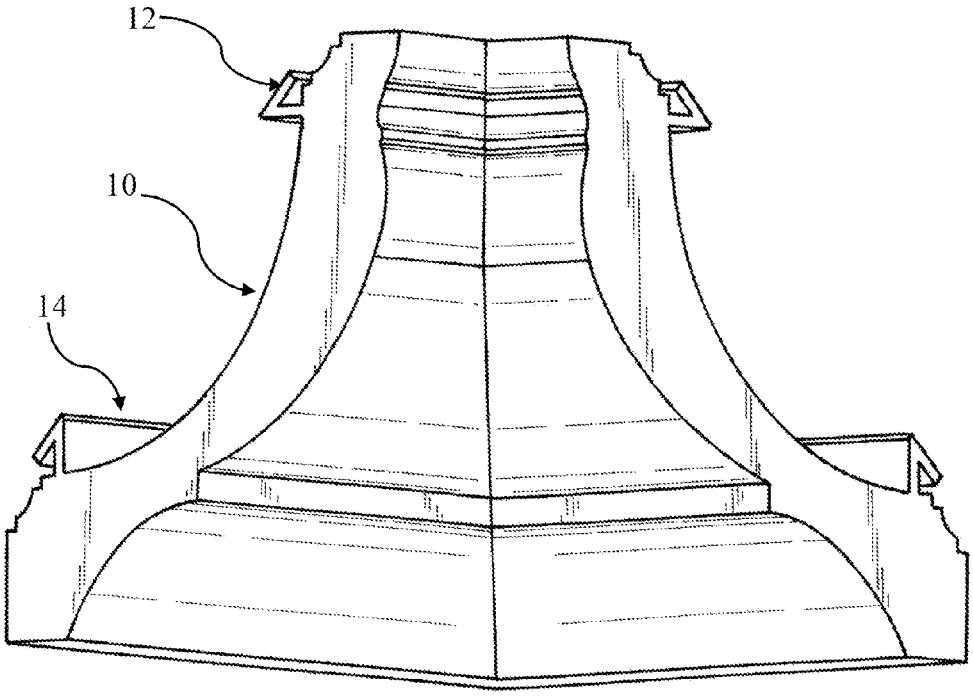
FIG. 10 is a perspective front view of the inside corner cover of the crown molding system of the present invention.

FIG. 10 is a perspective front view of the inside corner cover 10 of the crown molding system of the present invention. This unit which has an upper track 12 and a lower track 14 is inserted onto the outer tracks of the crown molding housing at the junction or joint where the ceiling and the two walls intersect. It is designed with a 90 degree angle to allow the crown molding housing to continue around corners where the two walls meet at a 90 degree angle.

Figure 11:
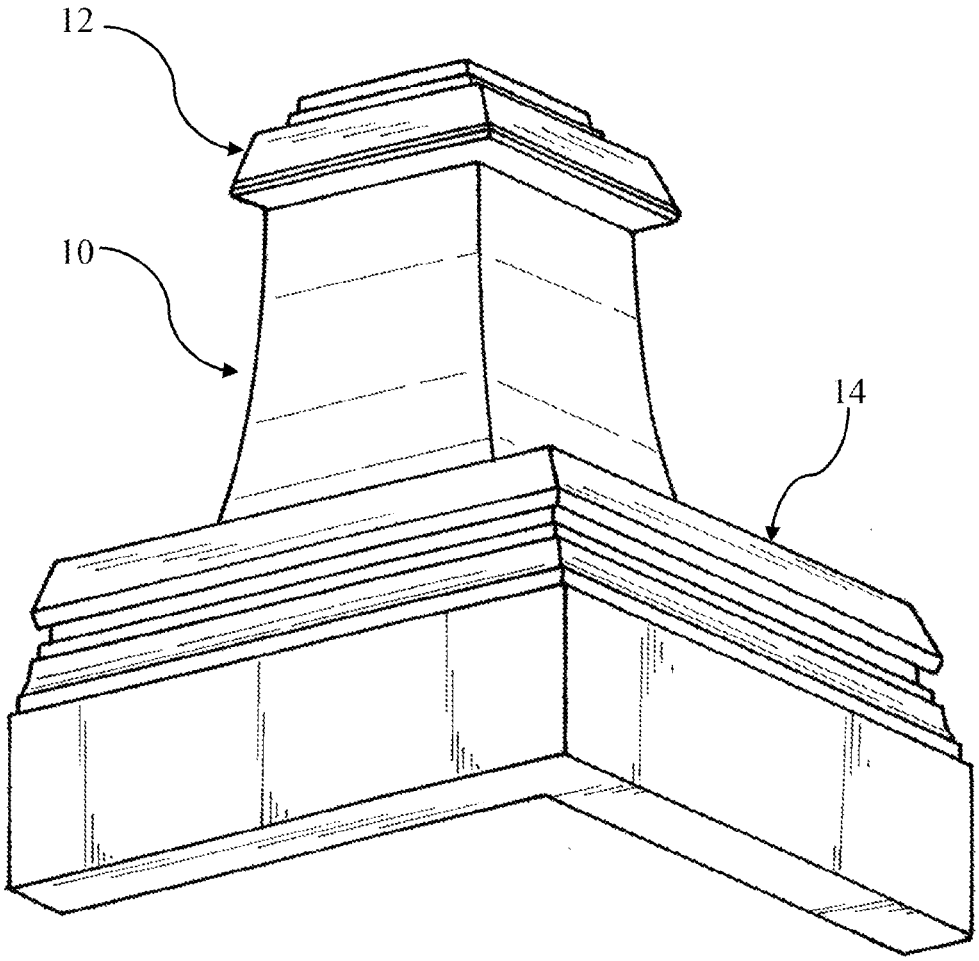
FIG. 11 is a perspective rear view of the inside corner cover of the crown molding system of the present invention.

FIG. 11 is a perspective rear view of the inside corner cover 10 of the crown molding system of the present invention. This view shows the rear views of the upper track 12 and the lower track 14 of the corner cover 10 which are inserted into the crown molding housing and fastened to join the junction where the two walls and the ceiling meet.

Figure 12:
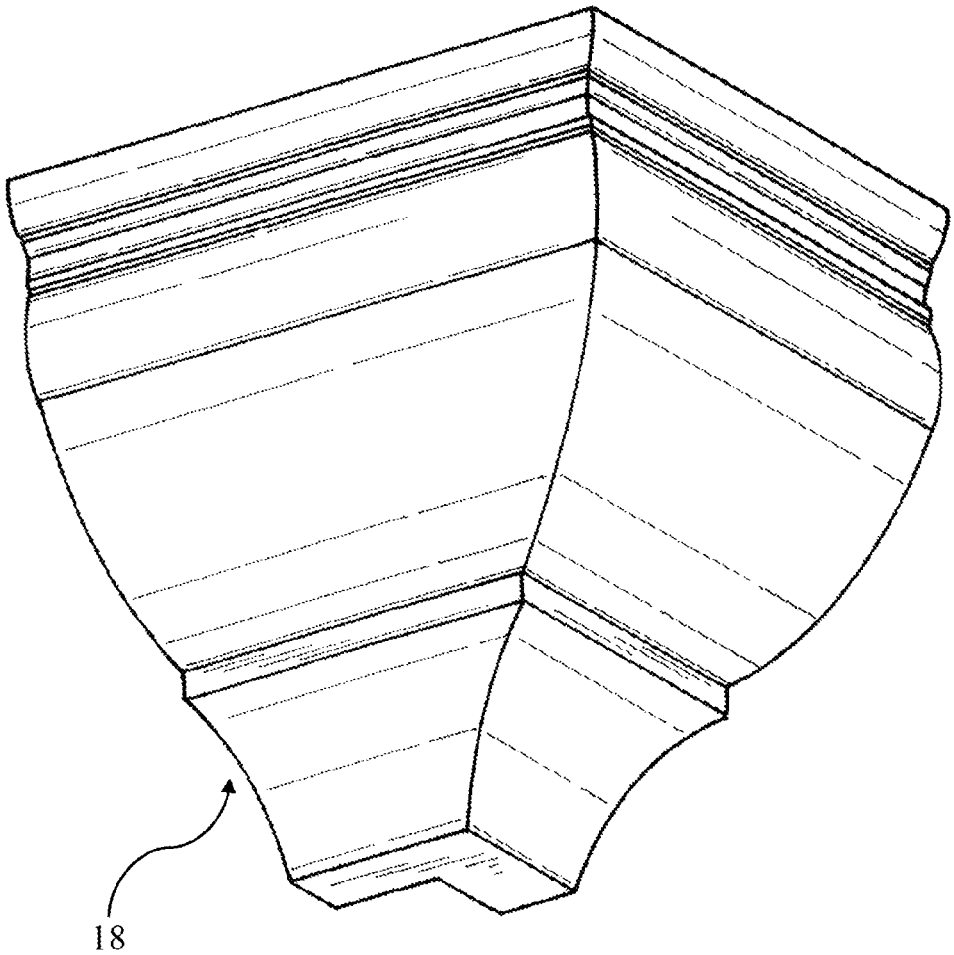
FIG. 12 is a perspective front view of the outside corner cover of the crown molding system of the present invention.

FIG. 12 is a perspective front view of the outside corner cover 18 of the crown molding system of the present invention. This unit is inserted onto the outer track of the crown molding housing at the junction or joint where the two walls and the ceiling intersect. This outside corner cover 18 is designed with a 90 degree angle to allow the crown molding housing to continue around the corners where the two walls meet at a 90 degree angle.

Figure 13:
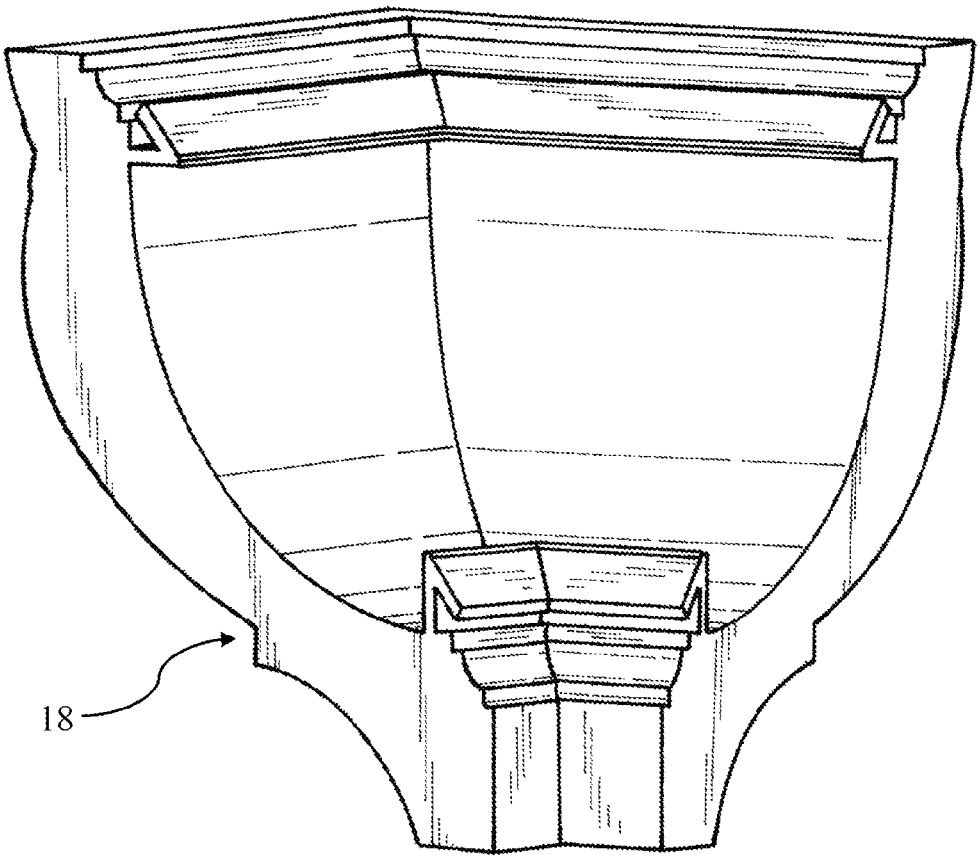
FIG. 13 is a perspective rear view of the outside corner cover of the crown molding system of the present invention.

FIG. 13 is a perspective rear view of the outside corner cover 18 of the crown molding system of the present invention. No cutting, gluing or screws are needed to insert this unit onto the outer track of the crown molding housing.

Figure 14:
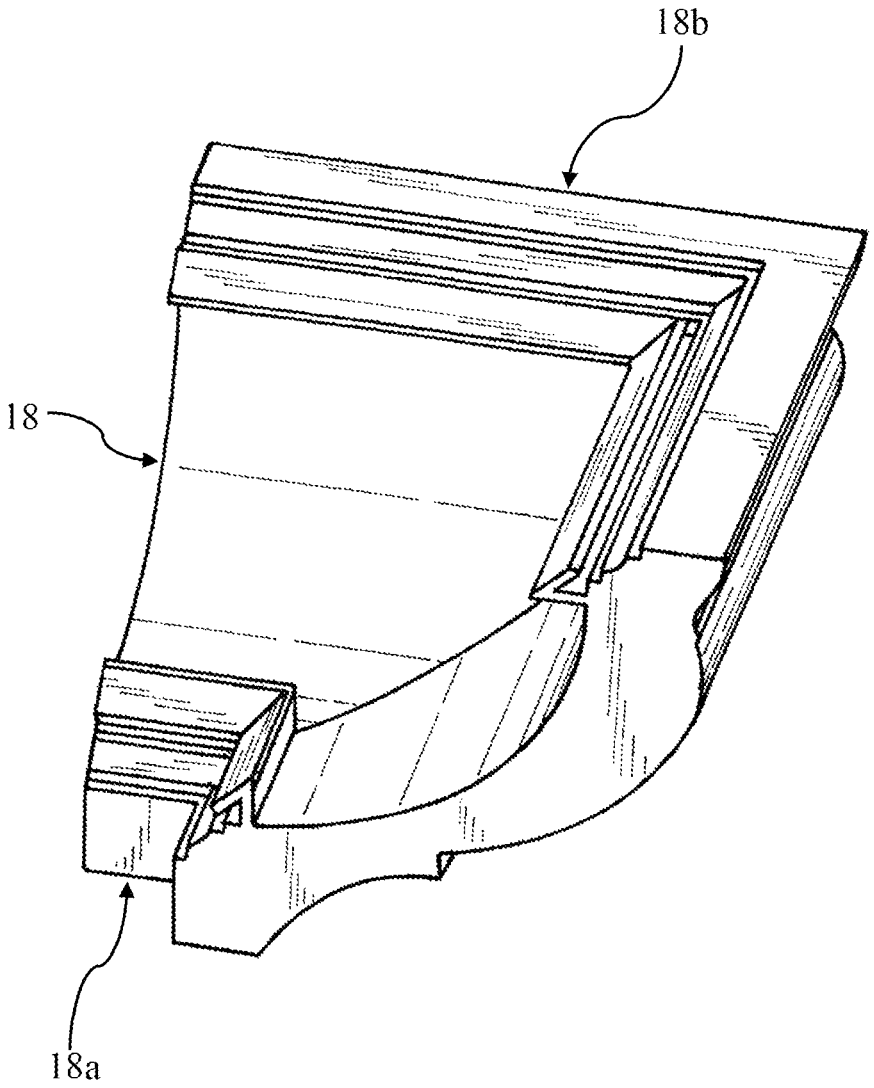
FIG. 14 is a perspective side view of the outside corner cover of the crown molding system of the present invention.

FIG. 14 is a perspective side view of the outside corner cover 18 of the crown molding system of the present invention. The upper track 18*a* and the lower track 18*b* are inserted onto the outer track of the crown molding housing and the unit is held in place without any screws or gluing when the crown molding housing is fastened at the joint of the ceiling and the walls.

Figure 15:
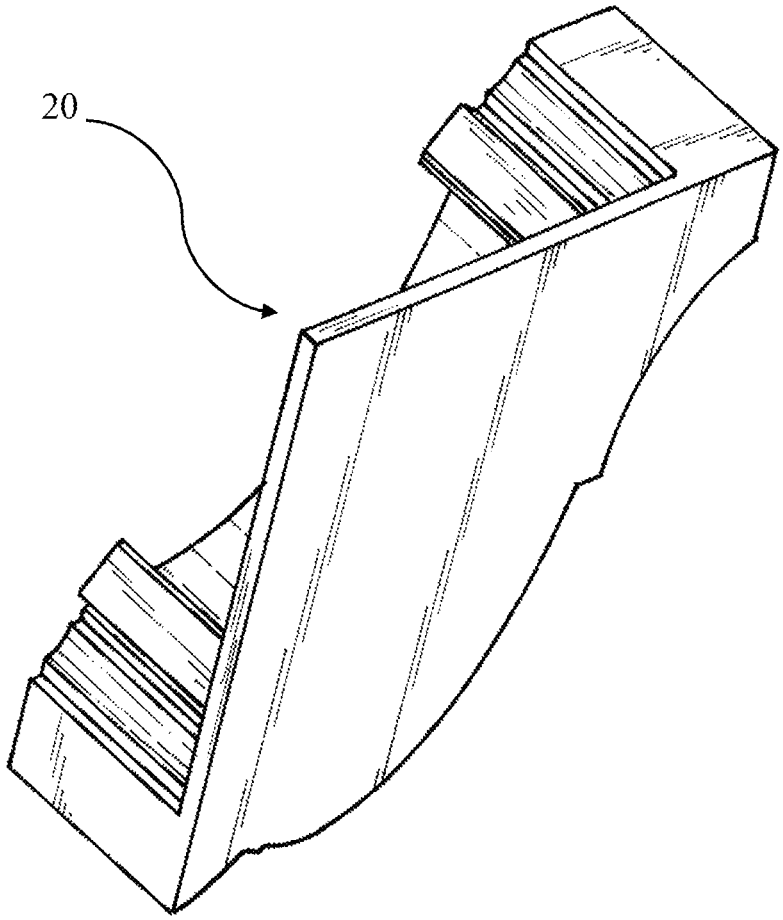
FIG. 15 is a perspective view of the right side of the crown molding housing end caps.

FIG. 15 is a perspective view of the right side of the crown molding housing end cap 20. The end cap 20 is inserted onto the outer track of the crown molding housing where the run ends in order to conceal any open ends of the crown molding housing and enhance the appearance of the décor. The end cap 20 is secured by sliding onto the outer track of the crown molding housing and does not require any screws or glue to secure it.

Figure 16:
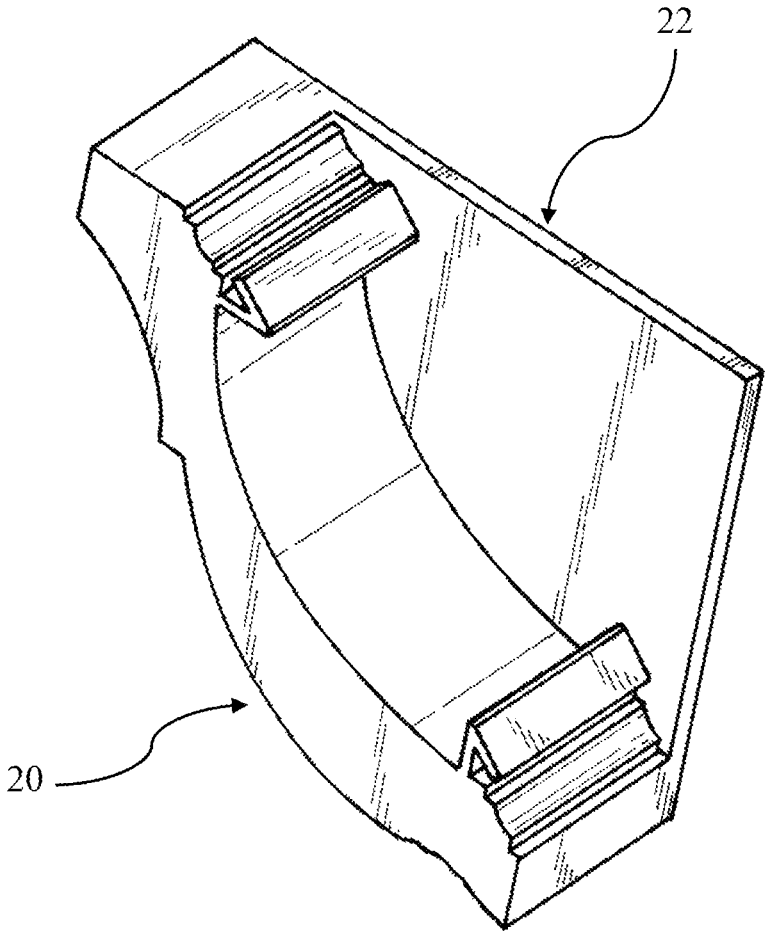
FIG. 16 is another perspective view of the crown molding housing end caps.

FIG. 16 is another perspective view of the crown molding housing end cap 20 illustrating further a cover plate 22 on one side which is used to conceal the open end of the crown molding housing.

The foregoing description of the themed modular ceiling and wall décor kit and system of the present invention accompanied by the drawings depicting the various parts of the kit should not be construed to limit the scope of the invention. It is to be understood that the embodiment of the present invention as described herein do not limit any application or scope of the invention and that the invention can be carried out and practiced in various ways and implemented in embodiments other than the one outlined in the description above. It is to be further understood that the phraseology and terminology used to describe the invention are for descriptive purposes only. It should be understood and obvious to one skilled in the art that alternatives, modifications, and variations of the embodiment of the present invention may be construed as being within the spirit and scope of the appended claims.

What is claimed is:

1. A themed modular wall décor kit comprising:

a crown molding housing structure comprising an outer track and an inner track;

a corbel structure for slidably engaging said outer track of said crown molding housing structure to conceal a joint between said crown molding housing structure and an adjacent crown molding housing structure connected to said crown molding housing structure;

a plurality of biscuit joiners each configured with slots to facilitate joining said crown molding housing structure to another adjacent crown molding housing structure in a tongue and groove connection to provide a seamless appearance;

a design panel inserted within said crown molding housing structure at said inner track;

an inside corner cover inserted into said outer track of said crown molding housing structure at a first intersection of a ceiling and a plurality of walls;

an outside corner cover inserted into said outer track of said crown molding housing structure at a second intersection of said ceiling and said plurality of walls;

an end cap having a cover plate inserted into said outer track of said crown molding housing structure to conceal open ends of said crown molding housing structure; and wherein said inside corner cover is inserted into said outer track of said crown molding housing structure at said first intersection where said ceiling and said plurality of walls intersect without screws or glue;

wherein said outside corner cover is inserted into said outer track of said crown molding housing structure at said second intersection where said ceiling and said plurality of walls intersect without screws or glue; and wherein said end cap having a cover plate is secured to said outer track by sliding on to said outer track of said crown molding housing structure without screws or glue.

2. The themed modular wall décor kit of claim 1 wherein the corbel structure has an upper track and a lower track, each of the upper track and the lower track for insertion into the outer track of the crown molding housing structure to slide on said outer track of the crown molding housing structure.

3. The themed modular wall décor kit of claim 1 wherein the corbel structure can be moved on the outer track of the crown molding housing structure in order to remove or insert a plurality of different design profile panels and to hide a gap between said plurality of different design profile panels.

4. The themed modular wall décor kit of claim 1 wherein the design panel is inserted into the inner track of the crown molding housing structure by sliding said design panel into said inner track of said crown molding housing structure and wherein said design panel can be removed from said inner track of said crown molding housing structure.

5. The themed modular wall décor kit of claim 1 wherein the design panel is removable, and replaceable with a plurality of different design panels of different textures, colors and designs to change a décor and a theme of a room.

6. The themed modular wall décor kit of claim 1 wherein the décor kit is constructed from extruded plastic which can be cut to a plurality of different sizes and shapes.

7. The themed modular wall décor kit of claim 1 wherein the crown molding housing structure can be installed and removed and re-installed in a different location.

* * * * *